United States Patent [19]

Ferrari

[11] Patent Number: 4,644,966

[45] Date of Patent: Feb. 24, 1987

[54] FINGERNAIL TREATMENT ARRANGEMENT

[75] Inventor: Luigi M. Ferrari, Douglaston Hills, N.Y.

[73] Assignee: Del Laboratories, Inc., Farmingdale, N.Y.

[21] Appl. No.: 595,929

[22] Filed: Apr. 2, 1984

Related U.S. Application Data

[62] Division of Ser. No. 451,328, Dec. 20, 1982, Pat. No. 4,466,452.

[51] Int. Cl.[4] ..... A45D 29/17

[52] U.S. Cl. ..... 132/73; 215/232

[58] Field of Search ..... 132/73, 73.5, 74.5; 215/232, 234

[56] References Cited

U.S. PATENT DOCUMENTS

| | | | |
|---|---|---|---|
| 3,791,545 | 2/1974 | Narusawa et al. | 215/232 |
| 4,282,891 | 9/1981 | Duceppe | 132/73.5 |
| 4,390,552 | 6/1983 | Niwa | 215/232 |

*Primary Examiner*—Paul J. Hirsch

*Attorney, Agent, or Firm*—Kirschstein, Kirschstein, Ottinger & Israel

[57] ABSTRACT

A fingernail treatment arrangement, especially a nail polish removal arrangement, includes a vessel which is closable by a lid and which includes a circumferential wall and a bottom wall which together bound an internal chamber. A porous body is so held in the internal chamber as to be inwardly spaced from the circumferential wall and to form a gap therewith. The porous body has a central through bore which extends through the porous body all the way to the bottom wall. The bottom wall has a downward slope in the radially outward direction to form a moat into which the porous body dips. The porous body is held in the aforementioned position either by a resilient spring clip which engages the same and braces itself against a neck portion of the vessel, or by ultrasonically or thermally welded formations connecting the porous body to the bottom wall, or in both ways. A treating liquid, especially a nail polish removing liquid, is poured into the internal chamber to flow into the gap and/or into the fingerhole and to permeate the porous body through the top and through the outer and/or inner circumferential surfaces thereof from the gap and/or from the finger hole. Rubbing a fingernail in the finger hole against the liquid-soaked porous body will dissolve and rub off the nail polish from the fingernail.

2 Claims, 4 Drawing Figures

FINGERNAIL TREATMENT ARRANGEMENT

This is a division of application Ser. No. 451,328 filed Dec. 20, 1982, now U.S. Pat. No. 4,466,452.

BACKGROUND OF THE INVENTION

The present invention relates to fingernail treatment arrangements in general, and more particularly to an arrangement for removing nail polish from fingernails.

An arrangement of this type is already known from the U.S. Pat. No. 4,282,891 which discloses a fingernail treating device that includes a flat-bottomed cylindrical container in which there is inserted a cylindrical sponge having a diameter somewhat exceeding the internal diameter of the container to be press-fitted therein and thus prevented from displacement relative to the container. The sponge is provided with slits or with a blind hole, so that the user of this device can insert a finger either into the slits, pushing the sponge out of the way during insertion, or into the blind hole. As the fingernail comes into contact with the sponge, the treating liquid, such as polish remover liquid, which permeates the sponge, will dissolve the nail polish and the friction between the sponge and the dissolved nail polish during the insertion, withdrawal, or other movement of the finger will remove at least a predominant part of the nail polish and retain the same in the sponge. The finger may be turned or oscillated in the finger hole to speed up and otherwise improve the action of the liquid on the nail polish.

Experience with this conventional fingernail treating device has shown that it is disadvantageous in numerous respects. So, for instance, due to the pressure fit of the sponge in the container, part of the absorption capacity of the sponge is lost. Moreover, the material of the sponge may creep or become otherwise deformed, for instance, during a prolonged storage, so that it will no longer be retained in the container, whereby the treating function thereof will be impaired. In addition thereto, the previously removed nail polish will invariably accumulate at the bottom of the finger hole, that is, at an area which is likely to come into contact not only with the fingernail itself, but also with the finger, due to the resiliency of the portion of the sponge which is arranged between the finger hole and the bottom wall, with attendant undesirable soiling of the finger. Because of the flat configuration of the bottom of the container, a substantial amount of the liquid will be contained in the aforementioned portion, especially since such portion is only negligibly, if at all, compressed during the insertion of the sponge into the container, thus aggravating the above-mentioned problem. Also, a considerable amount of the liquid will have to be poured into the container before the sponge will become saturated with such liquid and thus fully operational. This pouring operation takes a considerable amount of time, especially when the sponge is only slotted, due to the limited flow rate of the liquid through the pores of the sponge.

Another important drawback of this known fingernail treating device is that the liquid contained therein is prone to leak out, either in its liquid form, or as a vapor, during the storage of the device, especially when the device is handled or stored in less than extremely careful manner. It will be appreciated that the leakage of the treating liquid in its liquid state can be prevented by tightly closing the lid, and by maintaining the device under all circumstances in its upright position in which the bottom wall of the container of the device is at the bottom of the device. On the other hand, it is not so easy to prevent the escape of the usually quite volatile treating liquid in its vapor state. No matter how tightly the lid is initially closed, vibrations to which the device is subjected, for instance, during its transportation, may loosen the lid at least to the extent that the vapor of the treating liquid will be able to gradually escape from the interior of the device between the lid and the container, especially when the device is subjected to elevated temperatures. So, for instance, on very hot days, or when the device is exposed to sun rays or is kept close to a heating unit or the like, the escape of the vapor of the treating liquid is considerably higher than at lower temperatures and the device may leak even though it does not leak at normal room temperature. On the other hand, should the did be so tight as to substantially prevent leakage, the pressure inside the device may cause the flat bottom to bulge out at elevated temperatures, and the device may topple, after which the pressure may expel the treating liquid in its liquid state. All of these problems have resulted in a situation where the above device has gained only a limited acceptance by the purchasing public.

SUMMARY OF THE INVENTION

Accordingly, it is a general object of the present invention to avoid the disadvantages of the prior art.

More particularly, it is an object of the invention to provide an arrangement for treating fingernails with a treating liquid, which does not possess the disadvantages of the conventional arrangements of this type.

Still another object of the present invention is so to construct the arrangement of the above type as to obtain improved treating action and to avoid or reduce the possibility of soiling of the fingers of the user.

It is yet another object of the present invention to develop an arrangement of the above type in which the time needed for introducing the treating liquid is reduced, the penetration of the liquid to the fingernails is enhanced, and the dangers of leakage of the liquid from the device and outward bulging of the bottom wall of the device beyond the circumferential wall prior to the first use of the device are avoided.

A further object of the present invention is to devise a method of manufacturing the arrangement of the type here under consideration in a manner achieving the above objects.

A concomitant object of the invention is so to design the arrangement as to be simple in construction, inexpensive to manufacture, easy to use, and reliable in operation nevertheless.

In pursuance of these objects and others which will become apparent hereafter, one feature of the present invention resides in an arrangement for treating fingernails with a treating liquid, especially with a nail polish remover, this arrangement comprising a vessel including a circumferential wall and a bottom wall which together bound a chamber; a liquid-absorbing porous body received in the chamber in a predetermined position and having such dimensions as to be spaced from the circumferential wall when in the predetermined position; means for holding the porous body in the predetermined position in the chamber of the vessel; and means for bounding a finger hole in the porous body for insertion of a finger thereinto and for treatment by the treating liquid absorbed in the porous body.

A particular advantage of the above-described construction of the fingernail treatment arrangement is that, due to the presence of the gap between the porous body and the circumferential wall, the porous body is not compressed, and thus all of its inherent porosity and of the attendant capillary action can come into play. Moreover, the treating liquid poured into the vessel will choose the path of least resistance, that is, it will flow from the top surface into the gap existing between the outer surface of the sponge and the inner surface of the circumferential wall of the vessel, and will rise to a certain level in this gap. Of course, some of the liquid will flow through the top surface of the porous body into the pores of the latter; however, at the same time, the liquid present in the gap or flowing on the outer surface of the porous body will also penetrate into the pores in the radially inward direction, thus speeding up the permeation of the porous body with the treating liquid.

Advantageously, the finger hole extends through the porous body substantially centrally of the chamber of the vessel all the way to the bottom wall. Thus, any liquid which may flow into the finger hole during the filling of the porous body with the treating liquid will reach the bottom, if not absorbed during its downward flow. For a short time, the liquid will form a pool in the finger hole at the bottom. However, within a short period of time, the capillary action of the porous body will remove the liquid from the pool. This effect is not achieved when a portion of the sponge is present at the bottom wall, as it is in the conventional device, since then the liquid is retained in the pores of this portion, resulting in an unpleasant squishing sound during the use of the device. Moreover, any nail polish remnants from a previous treating operation will descend all the way to the bottom wall, where they are kept at a distance from the finger of the user by the user's fingernail.

The aforementioned effect is further improved when the central portion of the bottom wall, that is, the portion onto which the finger hole opens, is raised relative to the marginal portion of the bottom wall which surrounds the central portion and merges with the circumferential wall. In this manner, there is formed a moat which receives any excess quantity of the liquid which cannot be absorbed into the porous body. A particularly advantageous embodiment of this concept of the present invention is obtained when the bottom wall has a concave configuration as considered from the chamber, that is, when the bottom wall gradually rises from the circumferential wall to the center of the vessel to provide the raised central portion. In this construction, the inclination of the upper surface of the bottom wall in the downward direction as considered in the radially outward direction will contribute to the flow of the liquid into the most.

The holding means which holds the porous body in its predetermined position in which it is spaced from the circumferential wall of the vessel and forms the aforementioned gap therewith advantageously include connecting formations interposed between the porous body and the bottom wall. While it is conceivable to use an adhesive which is not attacked or dissolved by the treating liquid to form the connecting formations, it is currently preferred to construct these connecting formations as welded formations, especially as ultrasonically welded formations. Such formations are relatively easy to make, and yet they have a suprisingly high durability, even after a prolonged storage of the arrangement under less than ideal conditions, such as at high temperatures or in high-humidity enviroments.

According to another aspect of the present invention, which may be used either by itself or in combination with the above-discussed connecting formations, the holding means includes a resilient clip interposed between the vessel and the porous body. A particularly advantageous construction using this expedient is obtained when the vessel is formed with a neck potion remote from the bottom wall and having dimensions smaller than the corresponding dimensions of the chamber, the resilient clip then being interposed between the neck portion and the porous body. The friction between the clip and the porous body, on the one hand, and between the clip and the vessel, on the other hand, will then prevent not only the extraction of the porous body through the neck portion, but also, at least to some extent, rotation of the porous body in the vessel. Advantageously, the clip has a substantially rectangular configuration with one dimension smaller than the corresponding dimension of the neck portion, so that the clip can be inserted into the interior of the vessel through the neck portion upon elastic deformation of the clip.

It is particularly advantageous when, in accordance with a further concept of the present invention, the vessel has an annular wall portion remote from the bottom wall and bounding an inlet opening for the chamber, and when there is further provided means for fluid-tightly closing the opening prior to the first use of the arrangement, this closing means advantageously including a foil having a marginal portion sealingly connected to the annular wall portion of the vessel around the entire circumference of the latter, and a fluid-impermeable central portion spanning the inlet opening and integral with the marginal portion. Then, either the connection of the marginal portion to the annular portion, or the central portion of the foil, is destructible to gain access to the inlet opening and through the same into the chamber and thus to the porous body. It should be apparent that, since the central portion of the foil is fluid-impermeable, the marginal portion of the foil is integral with the central portion of the foil, and the marginal portion is sealingly connected to the annular wall portion of the vessel all around the inlet opening, all possible paths for the escape of the treating liquid either in its liquid phase or in its vapor phase from the chamber of the vessel will be blocked, so long as the connection of the foil to the vessel and the foil itself remain intact. This expedient renders it possible to dispense with the otherwise existing requirement for extreme care in handling and storing the arrangement of the present invention, without sacrificing the fluid-tightness of the arrangement. Moreover, any tampering with the contents of the vessel prior to the purchase or first use of the arrangement will become readily evident, since either the connection of the foil to the vessel, or the foil itself will be damaged.

However, the provision and mounting of the foil as discussed above has an important additional advantage, which resides in the fact that the chamber of the vessel may be at a subatmospheric pressure at room temperature prior to the destruction either of the foil or of its connection to the vessel. This further improves the resistance of the arrangement to leakage, since the arrangement would have to be heated to a temperature substantially exceeding the normal room temperature before the pressure in the chamber would rise above the atmospheric pressure and thus before the development of any tendency of the treating liquid to leak from the arrangement due to positive pressure differential between the pressures inside and outside of the vessel.

The sealing effect of the foil is further enhanced when there is provided a lid removably mounted on the annular wall portion of the vessel and extending across the inlet opening across the foil from the latter. Advantageously, the lid has a portion which is juxtaposed with the foil and contacts the latter when the foil assumes a planar shape to prevent outward bulging of the foil as long as the foil is mounted on the annular wall portion of the vessel. This expedient prevents rupture of the foil when the pressure in the vessel exceeds the ambient pressure.

As mentioned before, the bottom wall of the vessel has a concave configuration as considered from the chamber in a currently preferred construction of the arrangement of the present invention. The concave configuration of the bottom wall achieves an additional advantage, in that the bottom wall is capable of yielding to superatmospheric pressure in the chamber without losing its concaveness. This yielding of the bottom wall reduces the strain on the other portions of the arrangement, that is, on the circumferential wall of the vessel and on the foil and, via the latter, on the lid. In any event, the concave bottom wall will not bulge beyond the outline of the circumferential wall, so that there will always be available a sufficient bottom area for resting of the arrangement on a flat surface, such as a shelf, without tendency on the part of the vessel to topple over. This expedient may be used whether or not the inlet opening is initially closed by the foil.

According to an additional aspect of the present invention, there is provided a method of manufacturing the arrangement of the above-discussed construction, which comprises the steps of introducing a predetermined quantity of the treating liquid at an elevated temperature through the inlet opening of the vessel into the aforementioned chamber, and sealingly closing the inlet opening by a foil spanning the inlet opening and connected to the vessel in a sealed manner around the entire circumference of the inlet opening. Advantageously, the liquid is filled into the chamber at a temperature above the usual room temperature-range, such as at a temperature between 40° and 50° C., so that cooling of the contents of the vessel subsequent to the closing of the inlet opening by the foil will create a partial vacuum in the chamber of the vessel, so long as the temperature of the contents of the vessel is not raised to the level at which the liquid was filled.

The novel features which are considered as characteristic of the invention are set forth in particular in the appended claims. The improved fingernail treatment arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
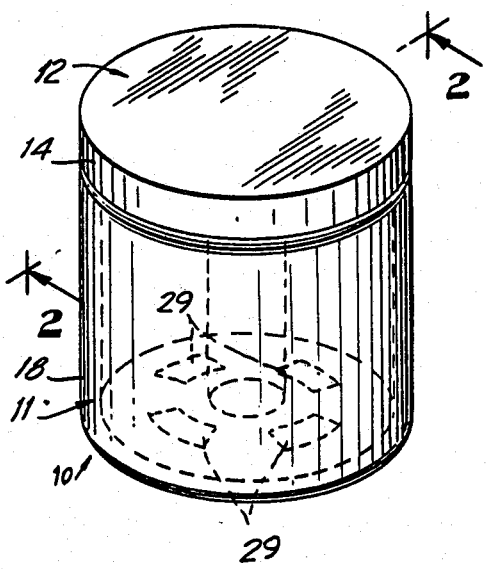
FIG. 1 is a perspective view of a vessel according to one embodiment of the present invention in its closed condition.

Referring now to the drawing in detail, and first to FIG. 1 thereof, it may be seen that the reference numeral 10 has been used therein to identify a fingernail treatment arrangement of the present invention in its entirety. The arrangement 10 includes, as two of its main components, a vessel 11 and a lid or cover 12 for the vessel 11. As shown in detail in FIG. 2, the vessel 11 has an externally threaded neck portion 13, and the lid 12 has an internally threaded rim portion 14 which meshes with the neck portion 13 in the closing position of the lid 12. The neck portion has a radially inwardly extending lip 15 provided with a bulge 16. In the tightened position of the lid 12, the bulge 16 engages either the lid 12, or, as shown, an elastic disc 17 situated in the lid 12, to achieve a sealing effect.

Figure 2:
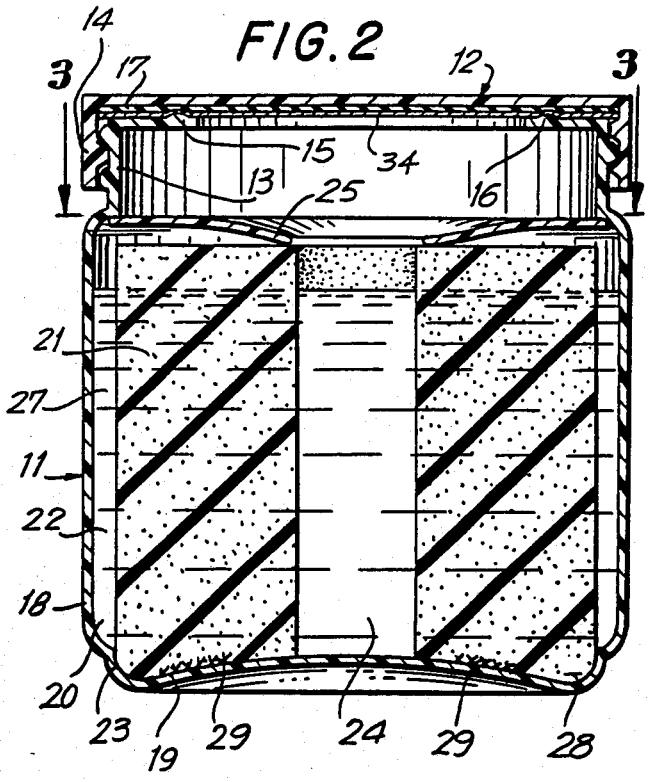
FIG. 2 is an axial sectional view taken on line 2—2 of FIG. 1.

The vessel 11 further includes a circumferential wall 18 which adjoins the neck portion 13 and has a diameter exceeding that of the latter, and a bottom wall 19 which extends across the space bounded by the circumferential wall 18 at an end portion of the latter which is remote from the neck portion 13. As shown in FIG. 2, for instance, the bottom wall 19 is curved in the upward direction, that is, it is concave as viewed from an internal chamber 20 of the vessel 11 which is bounded by the circumferential and bottom walls 18, 19. Thus, any liquid placed on the top surface of the bottom wall 19 will tend to flow in the radially outward directions.

A porous body 21, such as a sponge, is received in the internal chamber 20 in such a manner as to be radially inwardly spaced from the circumferential wall 18, thus forming a gap 22 therewith. This position is at least preliminarily dictated by an upturned portion 23 of the bottom wall 19. The porous body 21 has a central through finger hole 24 which extends all the way to the bottom wall 19 and opens onto the same.

Figure 3:
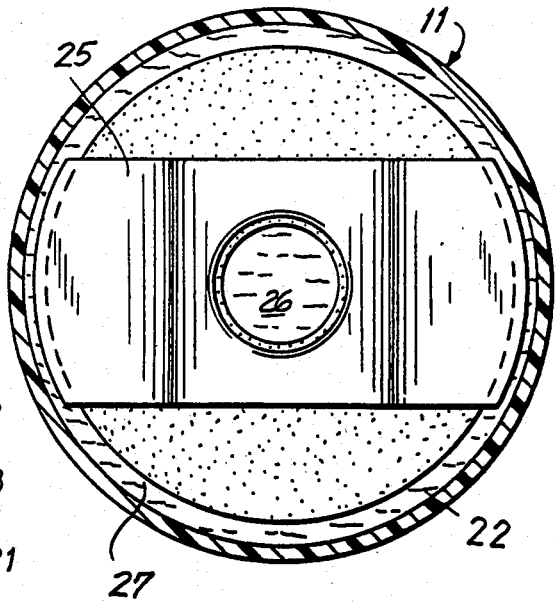
FIG. 3 is a cross-sectional view taken on line 3—of FIG. 2.

As a comparison of FIGS. 2 and 3 will reveal, the porous body 21 is retained against extraction through the neck portion and, at least to some extent, against rotation about the axis of the vessel 11 by a substantially rectangular spring clip 25 which resiliently engages from below the neck portion 13 and from above the porous body 21. The spring clip 25 has a central opening 26 through which a finger of the user of the arrangement 10 can be introduced into the finger hole 24 after the removal of the lid 12. A predetermined quantity of a treating liquid is introduced into the internal chamber 20 of the vessel 11 prior to the use of the arrangement 10, to form a liquid body 27 therein. The liquid body 27 will predominantly be absorbed in the porous body 21, while any excess liquid will be predominantly confined to the gap 22 and to a moat 28 formed by the bottom wall 19 inwardly of the upturned portion 23 and outwardly of the finger hole 24.

Instead of, or in addition to, the spring clip 25, the porous body 21 may be secured to the bottom wall 19 by formations 29 which are distributed substantially as indicated in FIG. 1. When the vessel 11 and the porous body 21 are made, as proposed by the present invention, of synthetic plastic materials, preferably of foamed polyurethane for the porous body 21 and of polyethylene for the vessel 11 inclusive of its bottom wall 19, they can be connected to one another, for instance, by a bonding agent or adhesive insoluble in the treating liquid and constituting the formations 29. However, the formations 29 are preferably welded formations, especially thermally or ultrasonically welded formations. Basically, such formations 29 are heat seals.

The arrangement 10 as described so far relies solely on the sealing contact between the bulge 16 and the lid 12 or the elastic disc 17 for sealing effect. However, experience has shown that, when the arrangement is filled with the treating liquid at the factory, subsequent handling, storage or transportation of the arrangement 10 may bring about escape of the treating liquid from the interior of the arrangement 10, either in its liquid form, or as a vapor, especially when less than very high degree of care is exercised during the handling, storage or transportation. To avoid this possibility, and also to provide a visual indication of possible tampering with the contents of the arrangement 10, the vessel 11 is provided, as also shown in FIG. 2, with a foil or a similar sealingly closing member 34 which spans an inlet opening 35 circumferentially bounded by the lip 15. The sealingly closing member 34 is impermeable to the treating liquid both in its liquid and its vapor state, and preferably also to other gaseous media, such as air. Aluminum foil readily offers itself for this purpose, since it has all of the desired qualities. The sealingly closing member is sealingly connected to the vessel 11, especially to the lip 15, all around the circumference of the inlet opening 35, so that the presence of the sealingly closing member 34 will prevent escape of the treating liquid from the interior of the vessel 11 practically indefinitely, whether or not the lid 12 is present, so long as the sealingly closing member 34 is not pierced or its connection to the vessel 11 is not damaged or destroyed. Of course, because of the presence of the foil or closing member 34, the bulge 16 will not directly contact the lid 12 or the elastic element 17; rather, such contact will take place through the intermediary of the foil 34 as long as the latter is present.

The presence of the sealingly closing member 34 also renders it possible to utilize another expedient according to the present invention, which further reduces the likelihood of escape of the treating liquid from the interior of the vessel 11. According to this feature of the present invention, the contents of the vessel 11 is maintained as subatmospheric pressure at least in the range of normal temperatures to which the arrangement 10 is expected to be exposed during storage, handling and transportation preceding the first use of the arrangement 10. This is achieved in that the treating liquid is filled into the interior of the vessel 11 at the manufacturing facility at an elevated temperature, such as at 35° to 40° C. or even slightly higher (but still well below the boiling temperature of the treating liquid). Then, the sealingly closing member or foil 34 is sealingly connected to the vessel 11, before the treating liquid had a chance to significantly cool down, for instance, by using a rapidly setting adhesive, or by forming a pressure-heat seal, between the sealingly closing member 34 and the vessel 11 all around the circumference of the inlet opening 35. Then, as the treating liquid cools down, the pressure of the vapors of the treating liquid contained in the interior of the vessel 11 will drop to subatmospheric, and will not rise to atmospheric pressure unless the temperature of the treating liquid in the vessel 11 is allowed to rise to above 40° C. or other filling temperature, by exposing the arrangement 11 to direct sunlight or other source of heat during improper storage or handling. However, even then, the pressure differential across the sealingly closing member 34 and the exterior of the vessel 11, should the temperature of the contents of the vessel 11 be permitted to rise to a level exceeding the filling temperature with attendant increase in the pressure of the contents to a superatmospheric level, is much lower than if the treating liquid were filled at room temperature of, for instance, 20° C., so that the possibility of leakage is still avoided even under these circumstances.

The prevalence of the subatmospheric pressure in the interior of the vessel 11 also brings about an additional advantage, in that outward bulging of the vessel 11 is avoided, even if the walls are relatively thin but sufficiently thick to avoid inward collapse. Outward bulging would be most detrimental at the bottom wall, where it could result in loss of stability and toppling over of the container or vessel 11, with attendant possibility of leakage or even of spilling when the outward bulging is permanent. In this respect, the inwardly curving configuration of the bottom wall 19 of the vessel 11 of the present invention brings about an additional advantage in that it resists outward bulging to a very high degree, due to the compressive nature of the forces or stresses evoked in the material of the bottom wall 11 under the influence of the pressure in the interior of the vessel 11 when such pressure rises above the atmospheric pressure, when the contents of the vessel 11 is unduly heated, and the inlet opening 35 is tightly closed, either by the foil 34 and the lid 12, or by the bulge 16 and the sealing element 17 of the lid 12. Moreover, the extent of outward yielding of the bottom wall 19 will be such, even under the most disadvantageous conditions, that the bottom wall 19 will still remain within the confines of the circumferentiall wall 18, that is, that it will not pass through or flip over across the plane of the lower end of of the circumferential wall 18. In this manner, it is assured that the bottom wall 19 will always be in contact with the supporting surface on which the vessel 11 rest along a relatively large-diameter circle, thus assuring stability.

Figure 4:
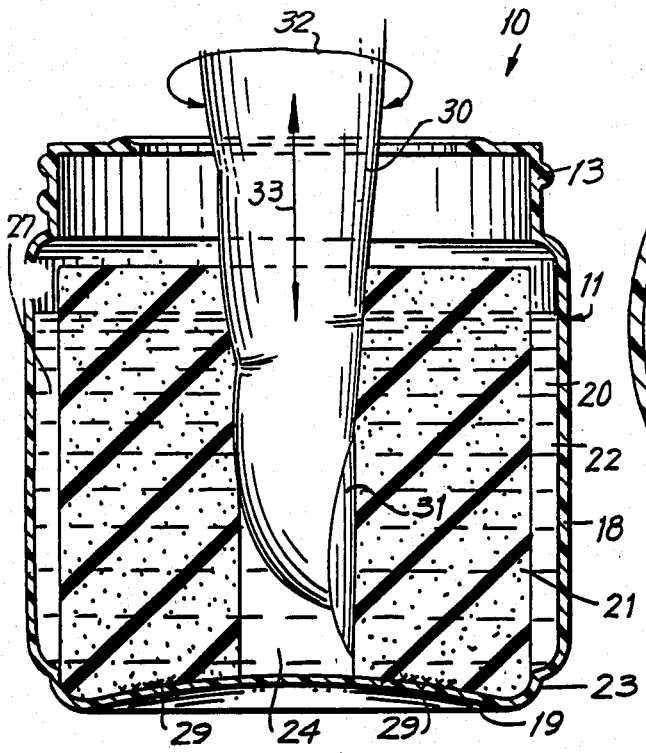
FIG. 4 is a view of another embodiment similar to that of FIG. 2 but with the vessel in its open condition during use thereof.

Having so described the construction of the fingernail treating arrangement 10 according to the present invention, its operation will now be explained with reference to the embodiment of FIG. 4, where the reference numeral 30 has been used to identify a finger of the user of the arrangement 10, while the reference numeral 31 has been used to designate a fingernail. The FIG. 4 embodiment is identical to the embodiment of FIGS. 2 and 3, except that the spring clip 25 is missing.

If the interior of the vessel 11 has been filled with the treating liquid at the manufacturing facility, and then sealed by the foil 34, the foil 34 is pierced or peeled off first, after the lid 12 has been removed. On the other hand, if the arrangement 10 has been purchased in its dry state, that is, without the treating liquid in the interior of the vessel 11, a quantity of the treating liquid is poured into the interior of the vessel 11 after the lid 12 has been removed. Then, the user of the arrangement inserts the finger 30 into the finger hole 24, and orbits or rotates the finger 30, as indicated by an arrow 32, or reciprocates the finger 30 in the finger hole 24, as indicated by an arrow 33, or both. During this movement, the fingernail 31 will rub against the liquid-soaked surface of the porous body 21, so that the nail polish will be dissolved by the treating liquid and will rub off.

It will be understood that each of the elements described above, or two or more together, may also find a useful application in other types of arrangements differing from the type described above.

While the invention has been illustrated and described as embodied in an arrangement for removing nail polish, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art, and, therefore, such adaptations should and are intended to be comprehended within the meaning and range of equivalence of the claims.

What is claimed as new and desired to be protected by Letters Patent is set forth in the appended claims.

I claim:

1. A method of manufacturing a leak- and spill-resistant arrangement for treating fingernails with a volatile nail polish remover predominantly absorbed in a liquid-absorbing porous body accommodated in a vessel having relatively thin walls constituted of synthetic plastic material and yieldable to superatmospheric pressure, comprising the steps of:

(a) heating a predetermined quantity of the nail polish remover to a temperature substantially in the range of 40° C. to 50° C. and below the boiling temperature of the nail polish remover;

(b) introducing the heated quantity of the nail polish remover through an inlet opening of the vessel into the interior of the latter for predominant absorption by the porous body, said heated quantity of the nail polish remover introduced within the vessel having a liquid state and a vapor state in at least one of which the heated quantity is prone to leak out of the vessel to the exterior thereof;

(c) sealingly closing the inlet opening, after the introduction of the heated quantity into the vessel, by sealingly connecting a fluid-impermeable foil around the entire circumference of the inlet opening and spanning the same; and (d) cooling the heated quantity of the nail polish remover sealingly closed within the vessel to room temperature and concomitantly causing a subatmospheric pressure to prevail within the vessel, said subatmospheric pressure being less than the atmospheric pressure prevailing at the exterior of the vessel to prevent escape of the nail polish remover within the vessel to the exterior thereof, and to resist outward bulging of the relatively thin vessel walls, thus assuring vessel stability and resistance to spilling.

2. The method as defined in claim 1, and further comprising the step of forming one of the walls of the vessel as a bottom wall with a concave configuration as considered from outside the vessel, said subatmospheric pressure within the vessel being insufficient to cause the bottom wall to lose its concaveness.

* * * * *